US005154222A

United States Patent [19]

Salaris et al.

[11] Patent Number: 5,154,222

[45] Date of Patent: Oct. 13, 1992

[54] DEVICE FOR THE CONTINUOUS CASTING OF THIN METAL PRODUCTS BETWEEN TWO COOLED ROTATING ROLLS

[75] Inventors: Cosimo Salaris, Metz; Jean-Pierre Birat, Semecourt; Jean-Luc Jacquot, Metz, all of France

[73] Assignee: Usinor Sacilor, Puteaux, France

[21] Appl. No.: 625,854

[22] Filed: Dec. 11, 1990

[30] Foreign Application Priority Data

Dec. 26, 1989 [FR] France ..... 89 17292

[51] Int. Cl.[5] ..... B22D 11/06

[52] U.S. Cl. ..... 164/428; 164/480

[58] Field of Search ..... 164/479, 480, 428

[56] References Cited

U.S. PATENT DOCUMENTS

| | | | |
|---|---|---|---|
| 4,580,615 | 4/1986 | Willim | 164/429 |
| 5,010,162 | 1/1992 | Blin et al. | 164/428 |
| 5,080,163 | 1/1992 | Blin | 164/428 |

FOREIGN PATENT DOCUMENTS

| | | | |
|---|---|---|---|
| 285963 | 10/1988 | European Pat. Off. | 164/428 |
| 2636259 | 3/1990 | France . | |
| 179543 | 10/1983 | Japan | 164/428 |
| 30260 | 2/1986 | Japan | 164/428 |
| 21444 | 1/1987 | Japan | 164/480 |
| 21445 | 1/1987 | Japan | 164/428 |
| 40955 | 2/1987 | Japan | 164/428 |

*Primary Examiner*—Richard K. Seidel

*Attorney, Agent, or Firm*—Frishauf, Holtz, Goodman & Woodward

[57] ABSTRACT

A device for casting thin metal products by solidifying the molten metal on the cooled lateral surfaces of two parallel horizontal rolls rotating in opposite directions, in which the casting space between the rolls is closed laterally by side dams each comprising an insert penetrating into the space between the rolls. A consumable or deformable material is provided between the rolls and the insert to provide a fluid-tight seal joint between the lateral faces of the inserts and the ends of the opposite rolls. The seal changes shaped by being consumed or deformed to maintain the fluid-tight seal as the rolls expand due to contact with the molten metal.

33 Claims, 1 Drawing Sheet

DEVICE FOR THE CONTINUOUS CASTING OF THIN METAL PRODUCTS BETWEEN TWO COOLED ROTATING ROLLS

BACKGROUND OF THE INVENTION

1. Field of the Invention

The invention relates to the continuous casting of thin metal products, particularly in steel. More particularly, it relates to installations referred to as being for casting between two rolls.

2. Description of the Prior Art

It will be understand that these installations comprise two rolls with substantially horizontal, parallel and coplanar axes, rotating about their respective axes in opposite directions and having cooled lateral cylindrical surfaces forming the walls of the ingot mould against which the cast molten metal solidifies. The casting space is limited laterally by closure plates, referred to as side dams, applied against the lateral faces of the rolls. The portions of the side dams in contact with the molten metal are generally made from a refractory material with good insulating properties. The side of the side dams turned towards the rolls can be entirely flat, but it may also have a projection, or "insert", penetrating inside the inter-roll space, as in French Patent 2,636,259 in the name of the Applicant. In French Patent No. 2,636,259, the contacts between the rolls and the side dams are in the form of a wedge and it is the front face of the insert which laterally limits the casting space. The depth of penetration of this insert into the inter-roll space may be uniform over its entire height or may diminish as it descends towards the gap at the center of the rolls. The insert is then said to be recessed.

The presence of this insert is advantageous, since it permits better control of the solidification of the product in the ingot mould relative to the side dams. However, control of the play provided between each roll and the protuberant part of the insert poses a problem. In fact, it is necessary to minimise the friction between the insert and the rolls so as not to disturb the operation of the machine and, at the same time, to prevent infiltrations of molten metal between the insert and the rolls, which may occur when the play exceeds 0.1 mm. The dimensions of the insert are fixed so that the play is sufficiently small when the machine is operating under hot conditions. That is to say when the rolls which have expanded through contact with the molten steel, the rolls have reached their final radius which is increased on the order of a half millimetre relative to their size at ambient temperature. However, this expansion is not immediate: it may be spread over approximately 10 seconds from filling of the casting space. During this period of time, the play between the roll and the insert retains values which may be too large to guarantee the leaktightness of the casting space.

SUMMARY OF THE INVENTION

An object of the present invention is to remedy this drawback of the side dams with an insert by permanently guaranteeing satisfactory leaktightness of the casting space with respect to the molten metal.

Another object of the invention is to provide a device for casting thin metallurgical products by means of solidification of the molten metal on the cooled lateral surfaces of two parallel horizontal rolls rotating in opposite directions about their respective axes and separated from one another so as to define a casting space which is closed laterally by side dams which each comprise an insert penetrating into the inter-roll space, comprising providing films of a consumable or deformable material to ensure an operational joint between the lateral faces of the inserts and the ends of the opposite rolls as the rolls heat up and thereafter.

Prior to casting, these films may be placed either on the lateral faces of the inserts or on the lateral surface of the rolls.

As will understood, the device according to the present invention makes it possible to achieve the leaktightness of the casting space, firstly when cold, and then throughout the duration of the expansion of the rolls, without said expansion being affected, since the leaktightness material is consumable or deformable and the thickness of the films does not diminish as the rolls expand.

BRIEF DESCRIPTION OF THE DRAWINGS

The invention will be better understood when reading the following description which refers to the appended figures.

DETAILED DESCRIPTION

Figure 1:
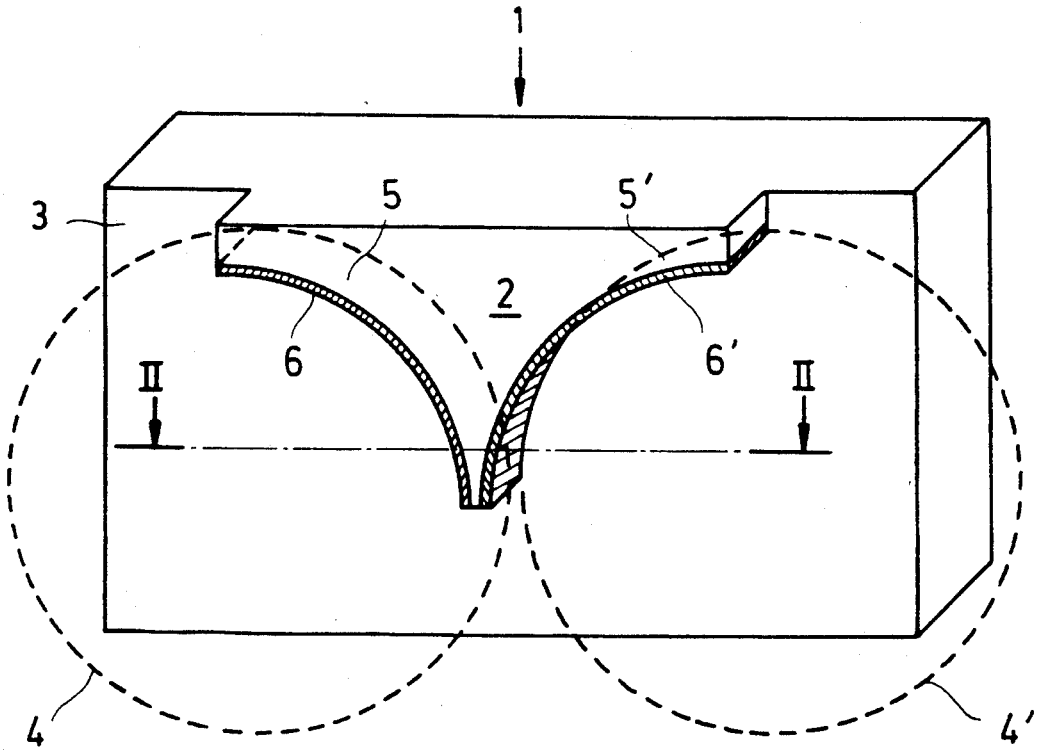
FIG. 1 is a front perspective view of a side dam with an insert equipped with a consumable or deformable film according to the invention.

FIG. 1 shows in isolation a possible configuration for a side dam 1 equipped with a projection, or insert, 2 intended to penetrate inside the inter-roll space. This insert is built into the side dam or is attached to its front face 3 which is fitted against the front surfaces of the rolls when the side dam is installed on the machine. The outlines 4, 4' of the front surfaces of the rolls are shown in broken lines in FIG. 1. The insert has two curved cutouts 5, 5' matching the form of the rolls. According to the invention, in the configuration shown, the surfaces of these cutouts 5, 5' are each coated with a film 6, 6' intended to ensure the leaktightness of the contact between the rolls and the surfaces of the cutouts 5, 5'. The film 6, 6' must satisfy various criteria.

Firstly, its initial thickness is such that, at the very start of casting, when the rolls are cold, the play between the film and the roll opposite the film does not exceed 0.1 mm in order to prevent infiltrations of molten metal between the roll and the cutout. Moreover, as the roll expands and frictionally contacts the film, the thickness of the film diminishes through wear and/or through compression. This reduction naturally follows the and generally matches expansion of the casing of the roll, since the variation in thickness of the film is linked to the pressure exerted by expansion. When the roll has reached its maximum expansion, which it will retain throughout the remainder of casting if the operating conditions remain stable, the film must be entirely consumed or have a stable residual thickness, so that the play between the roll and the cutout still does not exceed 0.1 mm.

In a known manner, the cutout of the insert may itself be coated with a metal foil (not shown) intended to reduce the wear of the insert in contact with the rolls.

The leaktightness film 6, 6′ is then deposited on this metal foil.

Figure 2:
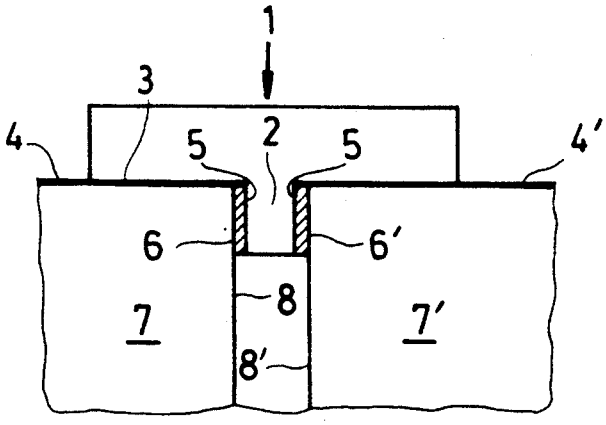
FIG. 2 is a section through II—II in FIG. 1, and also partially shows the rolls of the continuous casting machine.

FIG. 2 shows the side dam 1, which has just been described, mounted in a continuous casting machine, of which a portion of the rolls 7, 7′ is shown. In particular, the lateral surfaces 8, 8′ of the rolls, are in frictional contact against the films 6, 6′ may be seen from FIG. 2.

Figure 3:
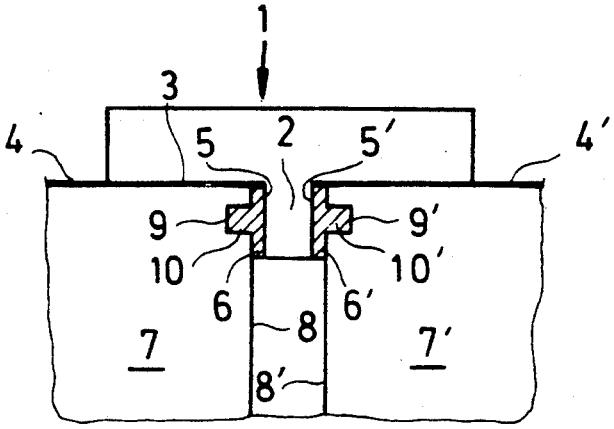
FIG. 3 shows an alternative embodiment of the device according to the invention under the same conditions as in FIG. 2.

In an alternative embodiment, the film 6, 6′ may be deposited not on the cutouts of the insert of the side dams, but on the rolls themselves prior to casting, as shown in FIG. 3. Each film thus forms a circular band surrounding one end of a roll. It is then recommended to hollow out grooves 9, 9′ on the lateral surfaces 8, 8′ of the rolls, in each of which grooves a protuberance 10, 10′ is made on the inner face of the film 6, 6′. This arrangement makes it possible to ensure the lateral retention of the films 6, 6′ during rotation of the rolls when the films are in frictional contact against the lateral surfaces 5, 5′ of the insert 2. The groove or the surface of the rolls may also comprise means, such as milling or rough patches, which serve to prevent or limit the sliding of the film on the roll.

The film may be made from a material which is consumable through wear, such as carbon or cellulose fibres. The reduction in thickness of the film may also principally be the result of the compressive force exerted on the film by the roll and the insert. The use of a metal softer than copper, such as aluminium or lead, is then perfectly suitable.

Of course, the invention is not restricted to the example which has just been described and shown. Various other configurations of the insert and of the side dam as a whole can be envisaged, the essential point being the presence of the leaktightness films with a thickness which decreases over time between the rolls and the lateral surfaces of the inserts as the casting rolls commence operation under hot conditions.

We claim:

1. A device for casting thin metal products comprising:

a pair of spaced apart rotatable horizontal parallel rolls, each of said rolls including:

first and second end portions;

a cooled cylindrical surface provided between the first and second end portions of the roll; and a longitudinal axes;

means for rotating the rolls in directions opposite to each other about their respective longitudinal axis;

first and second side dams respectively mounted on the first and second end portions of each roll;

the rolls and the side dams defining a casting space therebetween for retaining a molten metal therein, the molten metal being cast by solidifying on the cooled cylindrical surfaces of the rolls;

insert means mounted on each of the side dams, the insert means penetrating into the casting space;

each of the insert means having at least two edge portions, each of the at least two edge portions being respectively positioned adjacent to a different one of the first and second end portions of the first and second rolls; and a plurality of conformable film sealing means fixedly positioned respectively between each of the at least two edge portions of each insert means and the respective adjacent end portions of the first and second rolls for providing a conformable fluid tight seal therebetween, each conformable film sealing means having a thickness that is capable of being varied to compensate for expansion of the rolls as the rolls are heated by the molten metal in the casting space during an intermediate thermal expansion of the rolls as the rolls are heated by the molten metal; and each of the conformable film sealing means is mounted, prior to casting, on the at least two edge portions of each of the insert means.

2. The device according to claim 1, wherein the conformable material comprises a metal softer than copper.

3. The device according to claim 1, wherein said conformable material comprises carbon.

4. The device according to claim 1, wherein said conformable material comprises cellulose fibres.

5. The device according to claim 1, wherein:

each of the plurality of conformable film sealing means comprises a film formed of a consumable material.

6. The device according to claim 1, wherein:

each of said plurality of films formed of a conformable material is respectively mounted, prior to casting, on each of the at least two edge portions of the inserts.

7. The device according to claim 1, wherein:

each of the conformable film sealing means comprises a film formed of a deformable material.

8. The device according to claim 7, wherein the deformable material comprises a metal softer than copper.

9. The device according to claim 7, wherein the deformable material comprises lead.

10. The device according to claim 7, wherein the deformable material comprises aluminum.

11. The device according to claim 7, wherein said deformable material comprises carbon.

12. The device according to claim 7, wherein said deformable material comprises cellulose fibers.

13. The device according to claim 7, wherein:

each of said films of deformable material comprises an annular band positioned, prior to casting, on the cylindrical surface of the rolls.

14. The device according to claim 13, further comprising:

grooves formed in each of the rolls for retaining each of the annular bands of deformable material on said rolls.

15. The device according to claim 1, wherein:

each of the plurality of conformable film sealing means is formed of a consumable material and wherein, the consumable material comprises lead.

16. The device according to claim 1, wherein:

each of the plurality of conformable film sealing means is found of a consumable material and wherein the consumable material is aluminum.

17. A device for casting thin metal products comprising:

a pair of spaced apart rotatable horizontal parallel rolls, each of said rolls including:

first and second end portions;

a cooled cylindrical surface provided between the first and second end portions of the roll; and a longitudinal axes;

means for rotating the rolls in directions opposite to each other about their respective longitudinal axis;

first and second side dams respectively mounted on the first and second end portions of each roll;

the rolls and the side dams defining a casting space therebetween for retaining a molten metal therein, the molten metal being cast by solidifying on the cooled cylindrical surfaces of the rolls;

insert means mounted on each of the side dams, the insert means penetrating into the casting space;

each of the insert means having at least two edge portions, each of the at least two edge portions being respectively positioned adjacent to a different one of the first and second end portions of the first and second rolls; and a plurality of conformable film sealing means fixedly positioned respectively between each of the at least two edge portions of each insert means and the respective adjacent end portions of the first and second rolls for providing a conformable fluid tight seal therebetween, each conformable film sealing means having a thickness that is capable of being varied to compensate for expansion of the rolls as the rolls are heated by the molten metal in the casting space during an intermediate thermal expansion of the rolls as the rolls are heated by the molten metal; and wherein each of the conformable film sealing means comprises an annular band mounted, prior to casting, on the cylindrical surface of the rolls.

18. The device according to claim 17, further comprising grooves formed in each of the rolls for retaining the annular bands on the rolls.

19. The device according to claim 17, wherein the conformable material comprises a metal softer than copper.

20. The device according to claim 17, wherein said conformable material comprises carbon.

21. The device according to claim 17, wherein said conformable material comprises cellulose fibres.

22. The device according to claim 17, wherein:

each of the plurality of conformable film sealing means comprises a film formed of a consumable material.

23. The device according to claim 22, wherein:

each of said plurality of conformable films formed of a consumable material is respectively mounted, prior to casting, on each of the at least two edge portions of the inserts.

24. The device according to claim 17, wherein:

each of the conformable film sealing means comprises a film formed of a deformable material.

25. The device according to claim 24, wherein the deformable material comprises a metal softer than copper.

26. The device according to claim 24, wherein the deformable material comprises lead.

27. The device according to claim 24, wherein the deformable material comprises aluminum.

28. The device according to claim 24, wherein said deformable material comprises carbon.

29. The device according to claim 24, wherein:

each of said films of deformable material comprises an annular band positioned, prior to casting, on the cylindrical surface of the rolls.

30. The device according to claim 29, further comprising:

grooves formed in each of the rolls for retaining each of the annular bands of deformable material on said rolls.

31. The device according to claim 29, wherein said deformable material comprises cellulose fibers.

32. The device according to claim 17, wherein:

each of the plurality of conformable film sealing means is formed of a consumable material and wherein, the conformable material comprises lead.

33. The device according to claim 17, wherein:

each of the plurality of conformable film sealing means is formed of a consumable material and wherein the consumable material is aluminum.

* * * * *